US008148961B2

(12) United States Patent
Ha et al.

(10) Patent No.: US 8,148,961 B2
(45) Date of Patent: Apr. 3, 2012

(54) LOW-DROPOUT REGULATOR

(75) Inventors: Sang Hoon Ha, Gyunggi-do (KR); Sang Hee Kim, Seoul (KR); Jun Kyung Na, Gyunggi-do (KR); Shinichi Iizuka, Gyunggi-do (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 0 days.

(21) Appl. No.: 12/859,851

(22) Filed: Aug. 20, 2010

(65) Prior Publication Data

US 2011/0156677 A1 Jun. 30, 2011

(30) Foreign Application Priority Data

Dec. 24, 2009 (KR) ..... 10-2009-0130811

(51) Int. Cl.
*G05F 1/00* (2006.01)

(52) U.S. Cl. ..... 323/274

(58) Field of Classification Search ..... 323/273–275, 323/280; 327/538–546
See application file for complete search history.

(56) References Cited

U.S. PATENT DOCUMENTS 6,246,221 B1 * 6/2001 Xi ..... 323/280
6,333,623 B1 * 12/2001 Heisley et al. ..... 323/224
7,710,091 B2 5/2010 Huang

* cited by examiner

*Primary Examiner* — Jue Zhang
(74) *Attorney, Agent, or Firm* — Lowe, Hauptman, Ham & Berner, LLP

(57) ABSTRACT

A low-dropout regulator includes: a first operational amplifier having a first input receiving an input voltage; a first P-channel MOSFET having a gate connected to an output of the first operational amplifier, a source connected to a power source terminal, and a drain connected to an output terminal; a feedback circuit providing at least portion of a voltage of the output terminal as a feedback to a second input of the first operational amplifier; and a triode limiter circuit receiving voltages at the source and the gate of the first P-channel MOSFET comparing a voltage difference therebetween with a predetermined reference voltage, and increasing a voltage of the second input of the first operational amplifier when the voltage difference is the same as the reference voltage.

4 Claims, 1 Drawing Sheet

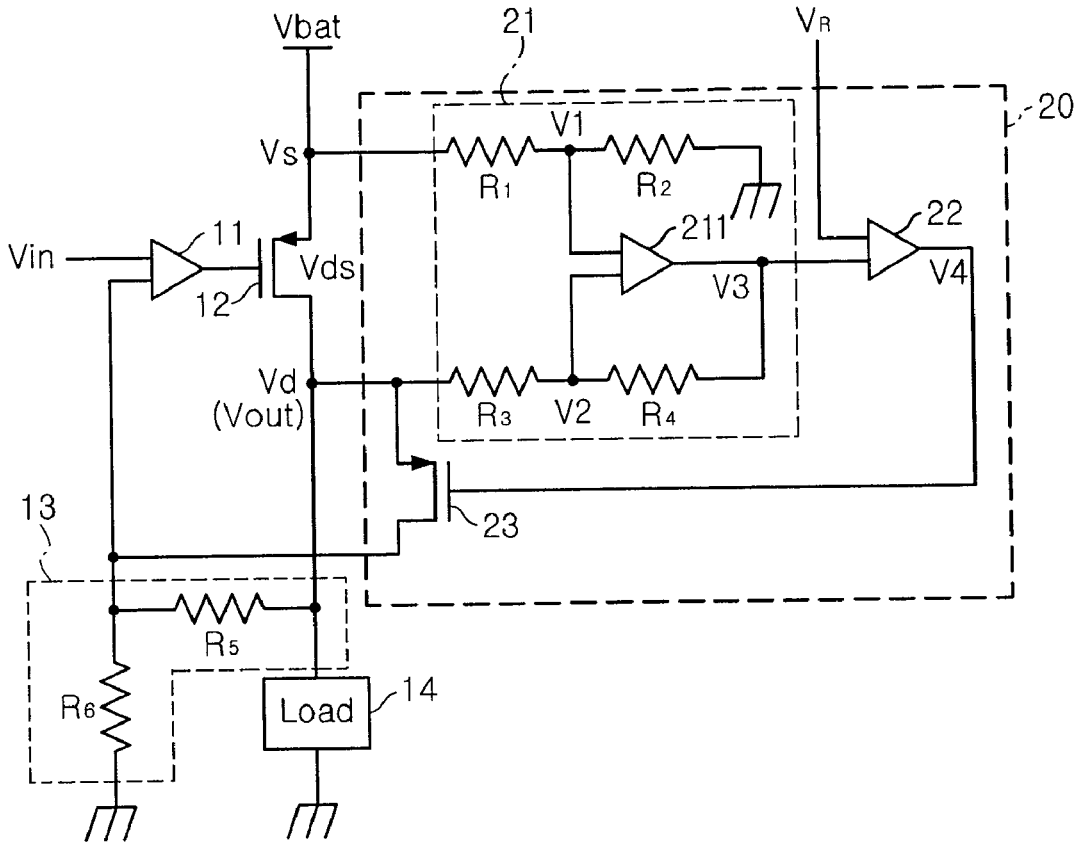
Vbat
21
VR
20
Vs
V1
R1
R2
211
22
Vin
11
Vds
V3
V4
12
Vd
(Vout)
R3
V2
R4
13
23
R5
R6
Load
14

LOW-DROPOUT REGULATOR

CROSS-REFERENCE TO RELATED APPLICATIONS

This application claims the priority of Korean Patent Application No. 10-2009-0130811 filed on Dec. 24, 2009, in the Korean Intellectual Property Office, the disclosure of which is incorporated herein by reference.

BACKGROUND OF THE INVENTION

1. Field of the Invention

The present invention relates to low-dropout regulators, and more particularly, to a low-dropout regulator that can prevent a metal-oxide-semiconductor field-effect transistor (MOSFET), applied to the lower-dropout regulator, from operating in a triode or deep triode mode.

2. Description of the Related Art

Low-dropout regulators are being used in the voltage supply circuits of electronic applications in various fields ranging from laptop computers to mobile communications terminals. A low-dropout regulator may be used when a specific load of an electronic device cannot directly use a power voltage, being provided from the outside, or the quality of the power voltage is not uniform. A low-dropout regulator outputs a controlled voltage in which the power voltage undergoes a low voltage drop.

Recently, research has been actively conducted into voltage and current-supply circuits using CMOS technologies. In particular, analog control blocks are in development in order to ensure the stability of circuit operations. The above-described low-dropout regulator is a type of analog control block and is manufactured using a CMOS process. Analog control blocks using this CMOS process require more accurate and stable control than existing circuits. In particular, an analog control block, that is, transistors, included in a low-dropout regulator, perform stable and rapid operations when operating in a saturation region. However, depending on operation schemes, the transistors may operate in the triode or deep triode region, which causes a reduction in the operation speed of the circuit and a decrease in stability. Therefore, there is a need for an improved circuit design method capable of preventing transistors, included in an analog control circuit, in particular, a low-dropout regulator, from operating in the triode or deep triode region.

SUMMARY OF THE INVENTION

An aspect of the present invention provides a low-dropout regulator capable of preventing transistors, included in the low-dropout regulator, from operating in a triode or deep triode region.

According to an aspect of the present invention, there is provided a low-dropout regulator including: a first operational amplifier having a first input receiving an input voltage; a first P-channel MOSFET having a gate connected to an output of the first operational amplifier, a source connected to a power source terminal, and a drain connected to an output terminal; a feedback circuit providing at least portion of a voltage of the output terminal as a feedback to a second input of the first operational amplifier; and a triode limiter circuit receiving voltages at the source and the gate of the first P-channel MOSFET comparing a voltage difference therebetween with a predetermined reference voltage, and increasing a voltage of the second input of the first operational amplifier when the voltage difference is substantially the same as the reference voltage to thereby prevent the first P-channel MOSFET from entering a triode mode or a deep triode mode.

The triode limiter circuit may include: a voltage difference generation circuit receiving the voltages at the source and the gate of the first P-channel MOSFET and outputting the voltage difference therebetween; a second operational amplifier receiving the voltage difference, output from the voltage difference generation circuit, and the reference voltage respectively through both inputs thereof; and a second P-channel MOSFET having a gate connected to an output of the second operational amplifier, a source connected to the output terminal; and a drain connected to the second input of the first operational amplifier.

The voltage difference generation circuit may include: a first resistor having one end connected to the source of the first P-channel MOSFET; a second resistor connected between the other end of the first resistor and a ground; a third resistor having one end connected to the drain of the first P-channel MOSFET; a fourth resistor having one end connected to the other end of the third resistor; and a third operational amplifier having both inputs connected to a connection node between the first resistor and the second resistor and a connection node between the third resistor and the fourth resistor, and an output connected to the other end of the fourth resistor, wherein the voltage difference generation unit outputs the voltage difference through the output of the third operational amplifier.

The feedback circuit may include at least two resistors connected in series between the output terminal, and the ground and one of connection nodes between the at least two resistors is connected to the second input of the first operational amplifier.

BRIEF DESCRIPTION OF THE DRAWINGS

The above and other aspects, features and other advantages of the present invention will be more clearly understood from the following detailed description taken in conjunction with the accompanying drawings, in which:

FIG. 1 is a circuit diagram illustrating a low-dropout regulator according to an exemplary embodiment of the prevention.

DETAILED DESCRIPTION OF THE PREFERRED EMBODIMENT

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

FIG. 1 is a circuit diagram illustrating a low-dropout regulator according to an exemplary embodiment of the invention.

As shown in FIG. 1, a low-dropout regulator according to this embodiment may include a first operational amplifier 11, a first P-channel MOSFET 12, a feedback circuit 13, and a triode limiter circuit 20.

More specifically, the first operational amplifier 11 may have an inverting input, a non-inverting input, and an output. The first operational amplifier 11 may receive an input voltage Vin, being provided from the outside, through any one of both inputs, in order to determine an output voltage of the low-dropout regulator. In order to clarify the description of the invention, one of the inputs of the first operational amplifier 11, to which the input voltage Vin is applied, may be referred as a first input, and the other input may be referred to as a second input. A voltage corresponding to an output voltage Vout, being output from an output terminal of the low-dropout regulator, is fed-back to the second input. The first operational amplifier 11 compares the input voltage and the voltage corresponding to the output voltage being fed-back, which are applied to both inputs thereof, with each other to thereby generate an output allowing for control so that both voltages being input to both inputs are equal to each other. That is, the first operational amplifier 11 can substantially serve as an error amplifier.

The first P-channel MOSFET 12 has a gate connected to the output of the first operational amplifier 11, a source connected to a terminal of the power voltage Vbat, and a drain connected to the output terminal. The first P-channel MOSFET 12 reduces the magnitude of the power voltage Vbat, having been applied to the gate thereof, by a predetermined level according to the output of the first operational amplifier 11, which is applied to the gate thereof, and outputs the output voltage Vout of the output terminal to the drain to which the load 14 is connected.

When the magnitude of the input voltage Vin, which is applied to one input of the first operational amplifier 11, is increased in order to increase the output voltage of the low-dropout regulator, the output voltage being output from the drain of the first P-channel MOSFET 12 is increased while a voltage difference Vds between the drain and the source of the first P-channel MOSFET 12 is decreased. Therefore, the first P-channel MOSFET 12 comes to operate in a deep triode region, past a triode region. As the first P-channel MOSFET 12 operates in the deep triode region, the operation speed of the circuit, controlling the output voltage Vout, is reduced, and the operation thereof becomes unstable. Therefore, according to the embodiment of the invention, the triode limiter circuit 20 is provided in order to prevent the first P-channel MOSFET 12 from operating in the deep triode region in which an unstable operation occurs. The triode limiter circuit 20 will be described in more detail below.

The feedback circuit 13 feedbacks at least portion of the output voltage Vout of the output terminal to the second input of the first operational amplifier. For example, as shown in FIG. 1, the feedback circuit 13 may be composed of a plurality of resistors $R_5$ and $R_6$ that are connected in series between the output terminal of the low-dropout regulator and the ground. A connection node between the resistors $R_5$ and $R_6$ may be electrically connected to the second input of the first operational amplifier 11 so that a voltage, divided by the resistors $R_5$ and $R_6$, connected in series with each other, is provided to the second input of the first operational amplifier 11.

As described above, the triode limiter circuit 20, which is used to prevent the first P-channel MOSFET 12 from operating in the deep triode region, in which an unstable operation is caused, receives a source voltage and a gate voltage at the source and the gate of the first P-channel MOSFET 12, respectively, and compares the voltage difference Vds between the source and gate voltages with a predetermined reference voltage $V_R$. When the voltage difference Vds is substantially the same as the reference voltage $V_R$, the triode limiter circuit 29 increases a voltage of the second input of the first operational amplifier 11 to thereby prevent the first P-channel MOSFET 12 from entering a deep triode mode.

As shown in FIG. 1, the triode limiter circuit 20 may include a voltage difference generation circuit 21, a second operational amplifier 22, and a second P-channel MOSFET 23. The voltage difference generation circuit 21 receives the source voltage and the gate voltage of the first P-channel MOSFET 12 and outputs a voltage difference therebetween. The second operational amplifier 22 receives the voltage difference, output from the voltage difference generation circuit 21, and the reference voltage respectively through both inputs thereof. The second P-channel MOSFET 23 has agate connected to the output of the second operational amplifier 22, a source connected to the output terminal, and a drain connected to the second input of the first operational amplifier 11.

The voltage difference generation circuit 21 may include a first resistor $R_1$ having one end connected to the source of the first P-channel MOSFET 12, a second resistor $R_2$ connected between the other end of the first resistor R1 and a ground, a third resistor $R_3$ having one end connected to the drain of the first P-channel MOSFET 12, a fourth resistor $R_4$ having one end connected to the other end of the third resistor $R_3$, and a third operational amplifier 211 having both inputs connected to a connection node between the first resistor R1 and the second resistors $R_2$ and a connection node between the third resistor $R_3$ and the fourth resistor $R_4$, respectively, and an output connected to the other end of the fourth resistor $R_4$. The voltage difference generation circuit 21 having this configuration may output the voltage difference through the output from the third operational amplifier 211.

The operational effects of the low-dropout regulator having the above-described configuration according to the exemplary embodiment of the invention will now be described in detail.

As described above, the first operational amplifier 11 compares the input voltage Vin, being provided from outside, with a feedback voltage (a voltage divided by the resistors $R_5$ and $R_6$) corresponding to the output voltage Vout of the low-dropout regulator, and generates an output based on the comparison result. The output from the first operational amplifier 11 is applied to the gate of the first P-channel MOSFET 12, so that currents flow from the source to the drain of the first P-channel MOSFET 12 and the output voltage Vout of the low-dropout regulator is applied to the load.

As the input voltage Vin, being applied from the outside, increases, the output voltage Vout of the low-dropout regulator also increases. Since the output voltage Vout increases while the magnitude of the power voltage Vbat is constant, the voltage difference Vds between the drain and the source of the first P-channel MOSFET 12 is reduced.

The triode limiter circuit 20 according to this embodiment detects and compares the source voltage and the drain voltage of the first P-channel MOSFET 12, and compares the predetermined reference voltage $V_R$ with a voltage corresponding to the difference between the source voltage and the drain voltage of the first P-channel MOSFET 12 to thereby control the input voltage of the first operational amplifier 11. The reference voltage $V_R$ may be set to have a voltage level corresponding to a drain-source voltage, which serves as the boundary between the triode region and the saturation region of the first P-channel MOSFET 12.

The voltage difference generation circuit 21 of the triode limiter circuit 20 may output the voltage difference between the drain and the source of the first P-channel MOSFET 12 by the third operational amplifier 211 and the first to fourth resistors $R_1$ to $R_4$ connected thereto. As shown in FIG. 1, when the source voltage of the first P-channel MOSFET 12 is denoted by 'Vs', the drain voltage thereof is denoted by 'Vd', both input voltages of the third operational amplifier 211 are denoted by 'V1' and 'V2', and an output voltage from the third operational amplifier 211 is denoted by 'V3', the output voltage 'V3' may be determined by the following equations according to the characteristics of the operational amplifier.

$$V1=Vs*R_4/(R_3+R_4) \quad \text{[Equation 1]}$$

$$V2=(Vd-V_3)*R_6/(R_5+R_6) \quad \text{[Equation 2]}$$

According to the characteristics of the operational amplifier, since both inputs have the same potential, V1=V2 is satisfied. By applying this to the above Equations 1 and 2, Equation 3 is obtained as follows:

$$Vs*R_4/(R_3+R_4)=(Vd-V_3)*R_6/(R_5+R_6) \quad \text{[Equation 3]}$$

In Equation 3, when the first to fourth resistors $R_1$ to $R_4$ have the same resistance value, Vs=Vd−V3 is satisfied, and the output voltage V3 of the third operational amplifier 211 satisfies 'Vd−Vs', that is, it becomes the voltage difference Vds between the drain voltage and the source voltage of the first P-channel MOSFET 12.

The output from the third operational amplifier 211 is applied to one input of the second operational amplifier 22. As the reference voltage $V_R$, being set and input from the outside, is applied to the other input of the second operational amplifier 22, the second operational amplifier 22 outputs a low signal 0V when the reference voltage $V_R$ is equal to the output voltage of the third operational amplifier 211 (that is, V3=Vds is satisfied).

The second P-channel MOSFET 23, having the gate connected to the output of the second operational amplifier 22, is turned on when the second operational amplifier 22 outputs the low signal 0V, so that the drain and the source of the second P-channel MOSFET 23 become in ON states. Thus, the second P-channel MOSFET 23 directly applies the output voltage Vout of the low-dropout regulator to the second input of the first operational amplifier 11.

A voltage greater than the divided voltage being applied from the feedback circuit 13 is thereby applied to the second input of the first operational amplifier 11 so as to increase an output level. The drain voltage of the first P-channel MOSFET 12 correspondingly drops so that the first P-channel MOSFET 12 is prevented from entering the triode or deep triode region.

As set forth above, according to the exemplary embodiment of the invention, the first P-channel MOSFET 12 of the low-dropout regulator can be inhibited from operating in the triode or deep triode region according to the user's setting, thereby preventing instability in the circuit operation.

While the present invention has been shown and described in connection with the exemplary embodiments, it will be apparent to those skilled in the art that modifications and variations can be made without departing from the spirit and scope of the invention as defined by the appended claims.

What is claimed is:

1. A low-dropout regulator comprising:

a first operational amplifier having a first input receiving an input voltage;

a first P-channel MOSFET having a gate connected to an output of the first operational amplifier, a source connected to a power source terminal, and a drain connected to an output terminal;

a feedback circuit providing at least portion of a voltage of the output terminal as a feedback to a second input of the first operational amplifier; and a triode limiter circuit receiving voltages at the source and the gate of the first P-channel MOSFET comparing a voltage difference therebetween with a predetermined reference voltage, and increasing a voltage of the second input of the first operational amplifier when the voltage difference is substantially the same as the reference voltage to thereby prevent the first P-channel MOSFET from entering a triode mode or a deep triode mode.

2. The low-dropout regulator of claim 1, wherein the triode limiter circuit comprises:

a voltage difference generation circuit receiving the voltages at the source and the gate of the first P-channel MOSFET and outputting the voltage difference therebetween;

a second operational amplifier receiving the voltage difference, output from the voltage difference generation circuit, and the reference voltage respectively through both inputs thereof; and a second P-channel MOSFET having a gate connected to an output of the second operational amplifier, a source connected to the output terminal; and a drain connected to the second input of the first operational amplifier.

3. The low-dropout regulator of claim 2, wherein the voltage difference generation circuit comprises:

a first resistor having one end connected to the source of the first P-channel MOSFET;

a second resistor connected between the other end of the first resistor and a ground;

a third resistor having one end connected to the drain of the first P-channel MOSFET;

a fourth resistor having one end connected to the other end of the third resistor; and a third operational amplifier having both inputs connected to a connection node between the first resistor and the second resistor and a connection node between the third resistor and the fourth resistor, and an output connected to the other end of the fourth resistor, wherein the voltage difference generation unit outputs the voltage difference through the output of the third operational amplifier.

4. The low-dropout regulator of claim 1, wherein the feedback circuit comprises at least two resistors connected in series between the output terminal, and the ground and one of connection nodes between the at least two resistors is connected to the second input of the first operational amplifier.

* * * * *